US005387249A

United States Patent [19]

Wiecorek

[11] Patent Number: 5,387,249

[45] Date of Patent: Feb. 7, 1995

[54] SELF-CONTAINED ADJUSTABLE CHEMICAL INJECTION DEVICE

[76] Inventor: Vincent Wiecorek, 5415 SE. 52 Ave., Stuart, Fla. 34997

[21] Appl. No.: 60,029

[22] Filed: May 10, 1993

[51] Int. Cl.[6] ..... E03D 9/03

[52] U.S. Cl. ..... 4/225.1

[58] Field of Search ..... 4/225.1, 223, 224, 226.1, 4/227.1, 227.2, 227.3, 227.4, 227.5, 227.6, 227.7

[56] References Cited

U.S. PATENT DOCUMENTS

| | | | |
|---|---|---|---|
| 2,993,214 | 7/1961 | Franco | 4/225.1 |
| 3,290,698 | 12/1966 | Joyner et al. | 4/225.1 |
| 3,911,507 | 10/1975 | Johnson | 4/224 |
| 4,656,676 | 4/1987 | Dufau et al. | 4/225.1 |

FOREIGN PATENT DOCUMENTS

| | | | |
|---|---|---|---|
| 0037128 | 10/1886 | Germany | 4/227.1 |

*Primary Examiner*—Robert M. Fetsuga

*Attorney, Agent, or Firm*—Fishman, Dionne & Cantor

[57] ABSTRACT

A self-contained adjustable chemical injection device for use with toilets comprises a cylindrical container having an open end and a closed end. A water dissolvable chemical caplet is dropped into the container. An inverted U-shaped bracket or clip is attached to the container at one end thereof. The bracket provides means for hanging the container on a lip of a tank of a toilet bowl. A line or conduit is disposed on the container which has an inlet and at least one outlet connected through to the container. The inlet of the conduit is connected to an outlet of an adjustable valve. The valve has an inlet for connection to a refill tube from a toilet filler valve in the tank of a toilet bowl The inlet of the valve includes a partial bypass. A tube is connected to the bypass and terminates in a toilet tank overflow pipe of the tank. A tube is connected to an outlet of the container and terminates in the overflow pipe.

4 Claims, 2 Drawing Sheets

SELF-CONTAINED ADJUSTABLE CHEMICAL INJECTION DEVICE

BACKGROUND OF THE INVENTION

The present invention relates generally to chemical treatment of the water in toilet bowls. More specifically, the present invention relates to a self contained adjustable chemical injection device for chemically treating the water in toilet bowls.

Chemical treatment of the water in toilet bowls is well known. A solid dissolvable caplet is dropped into or suspended in the tank of a toilet bowl. Alternatively, a liquid is injected into the tank water from a bottle suspended in the tank of a toilet bowl. In either case, the tank water has the cleaning/disinfecting chemical dissolved or dispersed therein. Accordingly, this chemical contacts the other components in the tank (i.e., flapper, seals, diaphragm or "O" rings). The chemical typically contains a high concentration of chlorine or other chemicals which tend to damage or attack these tank components. Further, a large amount of chemical is wasted. More specifically, since most of the tank water enters the lower portion of the bowl to remove (i.e., flush) waste in the bowl down the drain pipe connected to the toilet, most of the water having the chemical for treatment is flushed down the drain. Therefore, only a small portion of the chemically treated water remains in the bowl. This waste of the chemical is not very efficient nor environmentally safe.

Accordingly, a need exists for a more efficient method of chemical treatment of toilet bowl water (i.e., reduced chemical waste). Also, with the present environmental concerns, it is preferred to reduce such chemical waste.

SUMMARY OF THE INVENTION

The above-discussed and other drawbacks and deficiencies of the prior art are overcome or alleviated by the self-contained adjustable chemical injection device for use with toilets of the present invention.

In accordance with the present invention the injection device comprises a cylindrical container having an open end and a closed end. A water dissolvable chemical caplet is dropped into the container. An inverted U-shaped bracket or clip is attached to the container at one end thereof. The bracket provides means for hanging the container on a lip of a tank of a toilet bowl. A line or conduit is disposed on the container which has an inlet and at least one outlet connected through to the container. The inlet of the conduit is connected to an outlet of an adjustable valve. The valve has an inlet for connection to a refill tube from a toilet filler valve in the tank of a toilet bowl. The inlet of the valve includes a partial bypass. A tube is connected to the bypass and terminates in a toilet tank overflow pipe of the tank. A tube is connected to an outlet of the container and terminates in the overflow pipe.

It is an important feature of the present invention that the chemical solution (i.e., the water/chemical in the container) is never combined with the tank water within the tank. Since the chemical is not dissolved in the tank water it does not come into contact with the other components in the tank (i.e., flapper, seals, diaphragm or "O" rings). As described hereinbefore, these chemicals tend to damage the tank components. Accordingly, unlike the prior art chemical treatment for toilet bowls wherein a caplet or liquid is suspended, injected or dropped in the tank water, the present invention prohibits the chemical from entering the water in the tank. This results in a more efficient and environmentally safe chemical treatment process for toilet bowl water. The present invention uses less chemical per flush and utilizes more of the chemical injected than the prior art.

The above-discussed and other features of and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
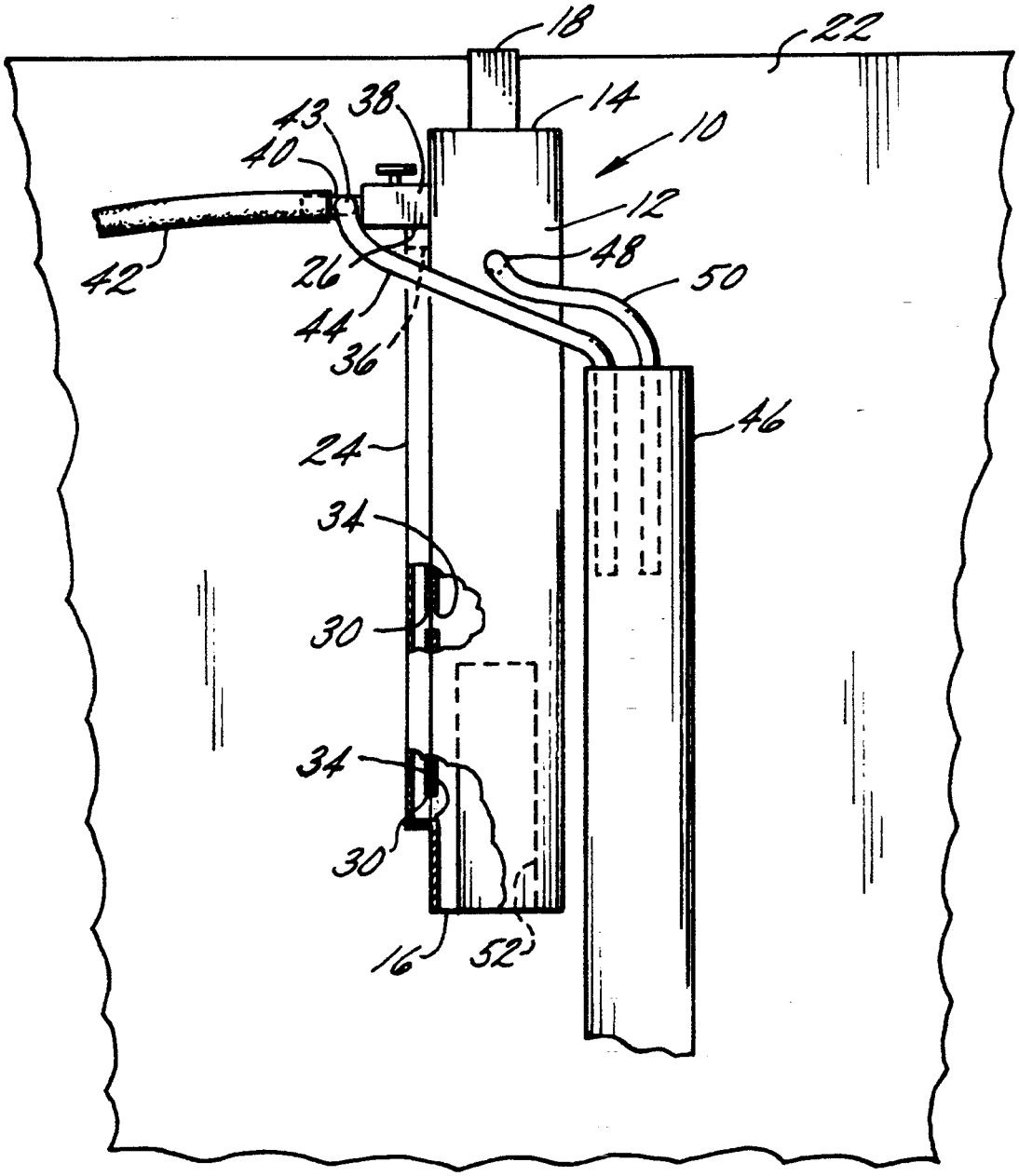
FIG. 1 is a front view of a self contained adjustable chemical injection device installed in a tank of a toilet bowl in accordance with the present invention.
Figure 2:
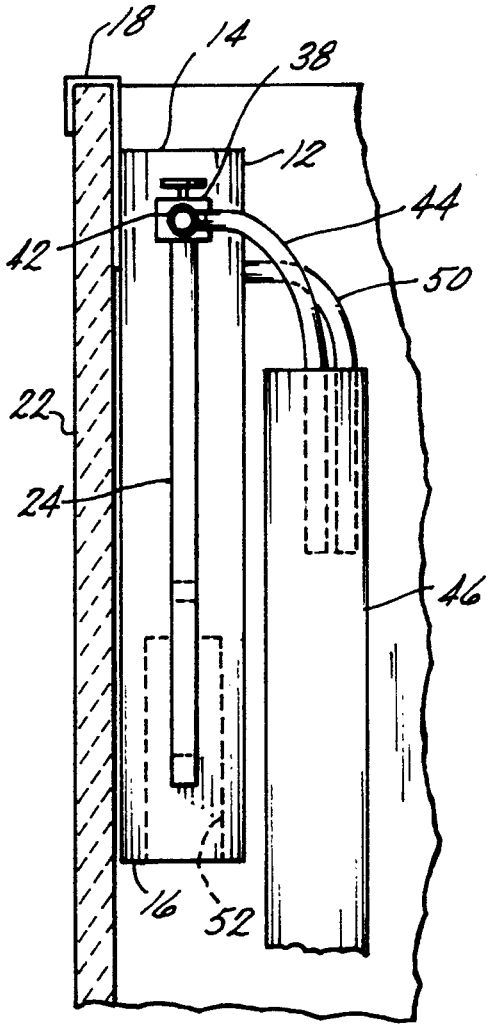
FIG. 2 is a side elevational view of the self contained adjustable chemical injection device of FIG. 1.
Figure 3:
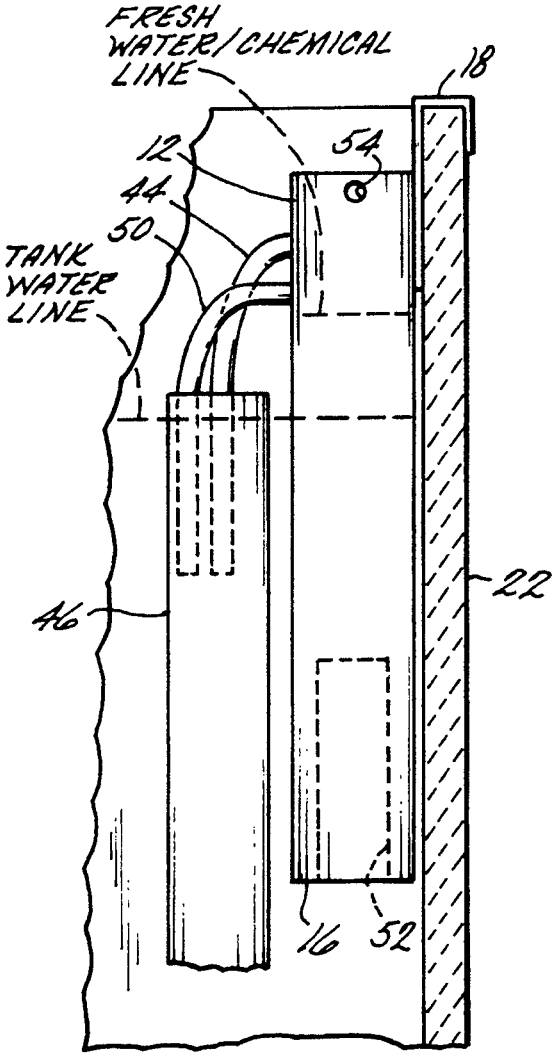
FIG. 3 is another side elevational view of the self contained adjustable chemical injection device of FIG. 1.

Referring to FIGS. 1–3, a self contained adjustable chemical injection device is shown generally at 10. Injection device 10 comprises a cylindrical container 12 having an open end 14 and a closed end 16. An inverted U-shaped bracket or clip 18 is attached to container 12 at one end thereof. Bracket 18 provides means for hanging container 12 on a lip 20 of a tank 22 of a toilet bowl. Bracket 18 is preferable mounted at the rear or back side of tank 22 so that it does not interfere with any of the other moving parts in tank 22 (e.g., ballcock, ballcock arm, filler valve) as are commonly found in most toilet bowls. A lid (not shown) rest on lip 20 of tank 22 as is well known. The lid also rests on bracket 18 thereby securing the attachment of bracket 18 to tank 22. It will be appreciated that most lids hang over lip 20 whereby bracket 18 will be concealed by the lid.

A line or conduit 24 is disposed on container 12. Conduit 24 has an inlet 26 and outlets 28, 30. Outlets 28 and 30 connect through openings 32, 34 in container 12. Inlet 26 of conduit 24 is connected to an outlet 36 of an adjustable valve 38. Valve 38 has an inlet 40 for connection to a refill tube 42 from a toilet filler valve in tank 22 of a toilet bowl. Inlet 40 of valve 38 includes a partial bypass 43. A tube 44 is connected to bypass 43 and terminates in a toilet tank overflow pipe 46 of tank 22 as is known. In a typical toilet bowl not employing the present invention, refill tube 42 from the filler valve would terminate directly in overflow pipe 46. Container 12 has an outlet 48 near the upper end thereof. A tube 50 is connected to outlet 48 and also terminates in overflow pipe 46.

To install injection device 10 in a toilet bowl, simply remove the tank lid and submerge device 10 in tank water. Hang container 12 on tank lip 20 as described hereinbefore. Remove refiller tube 42 from overflow pipe 46 and connect to inlet 40 of valve 38. Tube 42 may have to be cut to length or a new replacement tube may be employed. Connect tubes 44 and 50 to outlets 42 and 48 respectively and insert the free ends of these tubes into overflow pipe 46. These tubes are to be cut to lengths sufficient for remaining in overflow pipe 46 during operation. Some toilet bowls have a clip or fitting type device at the overflow pipe to which the refiller tube is originally connected. In these types of toilets, line 44 is preferably connected to this clip or fitting. A dissolvable caplet 52 for chemically treating the toilet bowl water is dropped into container 12. Caplet 52 is preferably a submergable caplet. For example, caplet 52 is 2000 Flushes commercially available from Block Drug Co., Jersey City, N.J. which is cut to size.

During operation (that is when the toilet bowl is flushed) fresh water flows from the filler valve to inlet 40 of valve 38 through tube 42. A portion of this fresh water flows from bypass 43 through tube 44 into overflow pipe 46 which then flows into the toilet bowl through holes about the rim of the bowl as is well known. The remainder of the fresh water at inlet 40 flows through outlet 36 of valve 36. Valve 36 is adjustable whereby the amount of fresh water to outlet 36 can be regulated. The fresh water from outlet 36 flows through conduit 24 to outlets 28 and 30 into container 12 at corresponding opening 32 and 34. Two outlets 28 and 30 are employed to stir up the water around the caplet to stimulate dissolution of caplet 52. However, it will be appreciated that any number of outlets to the caplet may be employed. The water/chemical level in container 12 will rise as the fresh water is injected. When this level reaches outlet 48 the water/chemical in container 12 will flow from outlet 42 through tube 50 into overflow pipe 46 which then flows into the toilet bowl through the holes about the rim described hereinbefore. It will be noted that the water/chemical level is always higher than the tank water level since the tank water level cannot exceed the top of overflow pipe 46 as is well known. This assures isolation of the water/chemical in container 12 from the tank water in tank 22. It is an important feature of the present invention that the chemical solution (i.e., the water/chemical in container 12) is never combined with the tank water within tank 22. Since the chemical is not dissolved in the tank water it does not come into contact with the other components in the tank (i.e., flapper, seals, diaphragm or "O" rings). As described hereinbefore, these chemicals tend to damage the tank components. Accordingly, unlike the prior art chemical treatment for toilet bowls wherein a caplet or liquid is suspended, injected or dropped in the tank water, the present invention prohibits the chemical from entering the water in the tank. This results in a more efficient and environmentally safe chemical treatment process for toilet bowl water. The present invention uses less chemical per flush and utilizes more of the chemical injected than the prior art.

The present invention introduces about twelve ounces of water/chemical into the toilet bowl while the prior art injects up to five gallons (depending on tank volume) of water/chemical into the toilet bowl.

Valve 38 is adjusted to regulate the amount of water flow through container 12, thereby regulating the amount of chemical solution entering the toilet bowl. A larger amount of chemical solution is generally required when the toilet is frequently used. Further, as most of these chemicals color the water in the toilet bowl, valve 38 can be adjusted to obtain a desired water color in the toilet bowl. Typically, the higher chemical concentration in the bowl the darker the color of the water in the toilet bowl.

More importantly, since most of the tank water enters the lower portion of the bowl to remove (i.e., flush) waste in the bowl down the drain pipe connected to the toilet, most of the water from the tank is flushed down the drain. In accordance with the prior art method most of the water/chemical is flushed down the drain and only a small portion remains in the bowl. Further, with the prior art method the chemically treated water generally does not reach under the rim (i.e., clean the entire toilet bowl). Most of the refill water is injected at the holes under the rim (i.e., from overflow pipe 46 as described hereinbefore) and remains in the tank after the toilet has been flushed.

Accordingly, since the present invention injects chemically treated water at the overflow pipe 46, very little of the chemical is flushed directly down the drain, it remains in the bowl to sanitize the same. Further, since only container 12 contains the chemical and not the much larger volume tank, less chemical is used per flush. Moreover, caplets dissolving in the small volume container 12 will last for more flushes than the same caplets dissolved in the larger volume tank. For the foregoing reasons it is believed that the present invention is significantly more environmentally friendly than the prior art method.

Further, an overflow 54 in container 12 may be employed to allow overflow if for some reason outlet 48 is blocked. It will be appreciated that the water/chemical will also flow over the top of container 12 (as it is open) during this situation.

The components of the present invention are preferably comprised of a plastic or other suitable material for continuous exposure to water and chemicals for treating toilet water.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A chemical injection device for use with a toilet having a tank and a bowl, the tank including a refill tube and an overflow pipe, the chemical injection device in combination therewith comprising:

a container receptive to a chemical for treating refill water entering the bowl from the overflow pipe, said container having an inlet near a lower end thereof and having an outlet, said outlet in communication with the overflow pipe of the tank;

bracket means mounted to said container for attaching said container to the tank;

a conduit disposed on and extending longitudinally along a substantial portion of said container, said conduit connected at one end thereof to said inlet of said container:

valve means mounted directly to the external surface of a sidewall of said container, said valve means having an inlet connected to the refill tube of the tank and an outlet connected to the other end of said conduit, said valve means for regulating flow from the refill tube through said conduit and into said container; and bypass means for bypassing said valve means and said container wherein a portion of flow from the refill tube flows directly into the overflow pipe;

whereby said valve means provides for adjustment of a volume of the chemical entering the bowl from the overflow pipe without restricting a total volume of refill water entering the bowl from the overflow pipe.

2. The device of claim 1 further comprising:

a tube connected at one end thereof to said outlet of said container the other end thereof disposed in the overflow pipe of the tank.

3. The device of claim 1 wherein said container comprises a cylindrical container having an open end and a closed end with said inlet and said outlet in said container.

4. The device of claim 1 wherein the chemical comprises a dissolvable chemical caplet.

* * * * *